United States Patent [19]

Readio et al.

[11] 4,141,850

[45] Feb. 27, 1979

[54] DISSOLUTION OF METALS

[75] Inventors: Philip D. Readio, Sparta; John L. H. Allan, Glen Rock, both of, NJ

[73] Assignee: Dart Industries Inc., Los Angeles, Calif.

[21] Appl. No.: 849,574

[22] Filed: Nov. 8, 1977

[51] Int. Cl.[2] ..... C09K 13/06; C23F 1/00; C23F 3/00

[52] U.S. Cl. ..... 252/79.4; 156/664; 252/187 R

[58] Field of Search ..... 156/666, 664; 252/79.2, 252/79.4, 79.4, 180, 186, 100, 95, 175, 146, 187 R; 423/27, 41, 272, 584, 508, 510; 75/101 R, 115, 117

[56] References Cited

U.S. PATENT DOCUMENTS

| | | | |
|---|---|---|---|
| 3,556,883 | 1/1971 | Naito et al. | 156/666 |
| 3,597,290 | 8/1971 | Naito et al. | 156/666 |
| 3,801,512 | 4/1974 | Solenberger | 156/666 |
| 3,945,865 | 3/1976 | Kamperman | 252/79.2 |
| 4,022,703 | 5/1977 | Bakes et al. | 252/79.4 |
| 4,048,006 | 9/1977 | Harbulak et al. | 156/664 |
| 4,052,254 | 10/1977 | Harbulak et al. | 156/664 |
| 4,086,176 | 4/1978 | Ericson et al. | 252/79.4 |

FOREIGN PATENT DOCUMENTS

| | | | |
|---|---|---|---|
| 7243729 | 3/1968 | Japan | 252/79.4 |

*Primary Examiner*—Jerome W. Massie

*Attorney, Agent, or Firm*—Margareta LeMaire; Bryant W. Brennan; Fred S. Valles

[57] ABSTRACT

Improved metal dissolution rates are obtained when using a solution containing sulfuric acid, hydrogen peroxide and certain primary diols.

25 Claims, No Drawings

DISSOLUTION OF METALS

The present invention relates to the dissolution of metals in an aqueous bath containing sulfuric acid and hydrogen peroxide, an in particular to a novel bath composition capable of effecting the dissolution at high rates. In one specific aspect the invention is concerned with etching of copper in the production of printed circuit boards.

BACKGROUND OF THE INVENTION

As is well known in the art, in the manufacture of printed electronic circuits a laminate of copper and etch resistant material, usually plastic, is used. A common method of obtaining the circuits is to mask the desired pattern on the copper surface of the laminate with a protective resist material, which is impervious to the action of an etch solution. In a subsequent etching step, the unprotected areas of the copper are etched away, while the masked areas remain intact and provide the desired circuiting supported by the plastic. The resist material can be a plastic material, an ink or a solder.

In the last few years, the industry has more and more turned to hydrogen peroxide-sulfuric acid systems for etching the electronic circuit boards, due to the low cost of the etching solutions and to the relative ease with which copper values can be recovered from the spent etch solutions.

However, there are many problems connected with the use of hydrogen peroxide as an ingredient in the etchants. It is a well known fact that the stability of hydrogen peroxide in a sulfuric acid-hydrogen peroxide solution is detrimentally affected by the presence of heavy metal ions such as copper ions. Thus, as etching proceeds and copper ion content of the etchant thereby increases, the etch rate will experience a serious drop-off due to the decomposition of the hydrogen peroxide in the etch bath, which will soon be exhausted. In order to improve the capacity of these etchants, various stabilizers have been suggested and used with some success for abatement of the hydrogen peroxide decomposition due to the presence of copper ions.

For instance, lower saturated aliphatic alcohols, such as methanol, ethanol, propanol and butanol, are disclosed in U.S. Pat. No. 3,597,290 as useful stabilizing additives to acidified hydrogen peroxide copper etching solutions. A disadvantage of these stabilized solutions is that they are sensitive to the presence of chloride or bromide ions and therefore precautions must be made to remove these ions from the etching system prior to use, e.g. by deionization or by precipitation of the contaminating ions, e.g. with a silver salt. Also, the alcohols are generally quite volatile at the elevated temperatures required in etching processes, and therefore, substantial losses of the stabilizer are incurred during operation.

Ethylene glycol, either in mono- or poly-form, is another compound which is known to stabilize acidified hydrogen peroxide solutions used in metal dissolution processes such as copper pickling (cf. U.S. Pat. No. 3,537,895) and etching (c.f. U.S. Pat. No. 3,773,577). In addition to the stabilizing effect, ethylene glycol also has other advantages in accordance with the teachings of these patents in that it has a relatively low volatility at normal operating temperatures and that it improves the etching and pickling rates somewhat. However, these rates are still not fast enough for many metal dissolution processes, and the problem of chloride and bromide sensitivity is also present with these stabilized metal treating solutions.

Although considerable retardation of the metal ion-induced hydrogen decomposition can be achieved by the addition of a suitable stabilizer, the etch rates of the stabilized hydrogen peroxide-sulfuric acid etchants have, generally, been quite low and in need of improvement especially at high copper ion concentrations. It has therefore been suggested in the prior art to add a catalyst or promoter to improve the etch rate. Specific examples of such catalysts are the metal ions disclosed in U.S. Pat. No. 3,597,290, such as silver, mercury, palladium, gold and platinum ions, which all have a lower oxidation potential than that of copper. Other examples include those of U.S. Pat. No. 3,293,093, i.e. phenacetin, sulfathiazole and silver ion, or the various combinations of any of the above three components with dibasic acids, as disclosed in U.S. Pat. No. 3,341,384, or with the phenyl ureas or benzoic acids of U.S. Pat. No. 3,407,141, or with the urea and thiourea compounds of U.S. Pat. No. 3,668,131.

Although silver ions thus appear to provide a universal solution to the above-discussed problem of low etch rates as well as that caused by the presence of free chloride and bromide ion content, there are still some disadvantages had with the use of silver ions in preparing hydrogen peroxide-sulfuric acid etch solutions. One of these is the high cost of silver. Another is that silver ions still do not promote the rate of etching as much as would be desired.

An object of the present invention is to provide a novel, highly efficient aqueous composition for the dissolution of metals.

Another object is to provide an improved method for the dissolution of metals, e.g. copper or alloys of copper, at high rates.

Still another object is to provide a composition and method for etching copper, wherein the etch rates are relatively unaffected by the presence of chloride or bromide ions.

Other objects of the invention will become readily apparent from the detailed description set forth hereinafter.

THE INVENTION

In accordance with the present invention there is provided a composition which comprises an aqueous solution of from about 0.2 to about 4.5 gram moles per liter of sulfuric acid, from about 0.25 to about 8 gram moles per liter of hydrogen peroxide, and an effective amount of a primary diol promoter having the general formula:

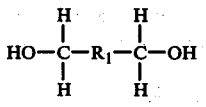

wherein $R_1$ is selected from:

(a) $-(C\ R_2\ R_3)_n-$, where each $R_2$ and $R_3$ independently from each other is either hydrogen or an alkyl group of 1 to 4 carbon atoms, and n is at least 2, or (b) a cycloparaffinic group or an alkyl-substituted cycloparaffinic group having from 5 to 7 carbon atoms in the ring structure and from 1 to 4 carbon atoms in any of the alkyl substitutions.

The sulfuric acid concentration of the etching solution should be maintained between about 0.2 to about 4.5 gram moles per liter and preferably between about 0.3 and about 4 gram moles per liter. The hydrogen peroxide concentration of the solution should broadly be in the range of from about 0.25 to about 8 gram moles per liter and preferably limited to 1 to about 4 gram moles per liter.

Examples of suitable primary diol promoters useful in the present invention include 1,4-butanediol, 1,5-pentanediol, 1,6-hexanediol, 1,7-heptanediol, etc.; 2-methyl-1,4-butanediol, 2-ethyl-1,5,-pentanediol; 3-propyl-1,5-pentanediol etc.; 1,4-cyclohexanedimethanol; 2-methyl-1,3-cyclopentanedimethanol; etc.

The promoters are added in effective quantities which usually amount to at least 0.01 gram moles per liter, preferably between about 0.1 and about 0.5 gram moles per liter.

The amount of promoter to be used in the solution is somewhat dependent on the free chloride or bromide content thereof. For instance, when the concentration of these contaminants are low, e.g. from about 2 to about 25 ppm, promoter concentrations in the lower part of, the range, e.g. from about 0.01 to about 0.2 gram moles per liter, are adequate for achievement of desired etch rates. Conversely, when the contaminants are present in relatively high concentrations, e.g. about 25 and up to 60 ppm, a promoter addition of at least 0.2 gram moles per liter should be used.

When n is either 0 or 1 in Formula (1) as is the case with ethylene glycol and propylene glycol, addition of any of these primary diols to a conventional etch solution does not result in acceptable etch rates when chloride or bromide ions are present. This is also the case with the poly forms of ethylene glycol and propylene glycol. Similarly, hydroxyl substituted paraffins containing one or more secondary or tertiary hydroxyl groups are not useful due to chloride and bromide sensitivity.

Water is used to make up the remaining portion of the etch solution. No special treatment is required to remove free chloride or bromide from the solution, since the presence of the cyclic alcohols or diols renders sufficient insensitivity to these contaminants, which otherwise would cause a severe decrease in etch rates.

The solutions may also contain other various ingredients such as any of the well known stabilizers used for counteracting heavy metal ion induced degradation of hydrogen peroxide. Examples of suitable stabilizers include those disclosed in U.S. Pat. No. 3,537,895; U.S. Pat. No. 3,597,290; U.S. Pat. No. 3,649,194; U.S. Pat. No. 3,801,512 and U.S. Pat. No. 3,945,865. The aforementioned patents are incorporated in this specification by reference. Of course, any of various other compounds having a stabilizing effect on acidified hydrogen-peroxide metal treating solutions can be used with equal advantage.

Also, any of the additives known to prevent undercutting, i.e. side or lateral etching, can also be added, if desired. Examples of such compounds are the nitrogen compounds disclosed in U.S. Pat. No. 3,597,290 and U.S. Pat. No. 3,773,577 both incorporated in this disclosure by reference. However, in the present invention, the use of such additives is not necessary, because of the rapid etch rates obtained due to inclusion of the promoters in the etching compositions.

The solutions are particularly useful in the chemical milling and etching of copper and alloys of copper, but other metals and alloys may also be dissolved with the solutions of this invention, e.g. iron, nickel, zinc and steel.

When using the solutions to dissolve a metal, conventional operating conditions for the particular metal are employed. Thus, in the etching of copper usually temperatures between about 105° to about 140° F. should be maintained and preferably the operating temperature should be between about 120° and about 135° F.

The solutions are eminently suited as etchants using either immersion or spray etching techniques. The etch rates obtained with the compositions of the invention are extremely fast. Because of these unusually high etch rates the compositions are especially attractive as etchants in the manufacture of printed circuit boards, where it is required that a relatively large number of work pieces be processes per unit time for economical reasons as well as for minimizing detrimental lateral etching or undercutting of the edges under the resist material. Another important advantage of the invention is that clean etching are achieved. Still another advantage is that the presence of free chloride or bromide ions in excess of 2 ppm and up to about 60 ppm, and even higher can be tolerated in the solutions with only a very slight sacrifice in etch rate. Thus, ordinary tap water can be used in preparing the solutions. Furthermore, the primary diol promoters of this invention have been found to have a considerable stabilizing effect on the hydrogen peroxide, thereby reducing or even obviating the need for additional hydrogen-peroxide stabilizers. Still another advantage is that the etch rates of the solutions are relatively unaffected by high copper loadings. Further advantages include low volatilities and high solubilities of the promoters in the solutions.

The following examples are provided as illustration of the invention.

EXAMPLES 1–5

In this set of comparative experiments copper laminates (2 × 2 inches) having a coating of 1 ounce copper per square foot were immersion etched in stirred solutions (800 ml) maintained at 129° F. Each of the solutions contained 15 volume percent 66° Baume sulfuric acid (2.7 gram moles/liter), 15 volume percent (50% w/w) hydrogen peroxide (2.6 gram moles/liter) and 70 volume percent of either deionized or distilled water. The solutions were stabilized with 2.5 grams/liter sodium phenolsulfonate. Without any catalyst and added chloride ions (Example 1) the time required to completely remove the copper from the bottom side of a laminate was 270 seconds (190–200 seconds with solutions prepared from distilled water).

The etch solutions of Examples 2–5 had the same compositions as that of Example 1, except that they also contained primary diol promoters as shown in Table 1. The results of the etching tests showed that all of the additives had a dramatic effect in improving the etch rates, both in the absence of added chloride ions or the presence of considerable quantities thereof, i.e. 45 ppm of added chloride ion.

TABLE I

| Example No. | Additive Name | Additive ml/l (g/l) | Etch Time, Sec. Without $Cl^-$ | Etch Time, Sec. With $Cl^-$ (45 ppm) |
|---|---|---|---|---|
| 1 | — | — | 270(190–200)(1) | — |
| 2 | 1,4-Butanediol | 20 | 95 | 125 |
| 3(1) | 1,5-Pentane- | 20 | 80 | 130 |

TABLE I-continued

| Example No. | Additive Name | ml/l (g/l) | Etch Time, Sec. Without $Cl^-$ | With $Cl^-$ (45 ppm) |
|---|---|---|---|---|
| | diol | | | |
| 4(4) | 1,6-Hexane-diol | (20) | 80 | 125 |
| 5(1) | 1,4-Cyclohexane-dimethanol | (20) | 75 | 115 |

(1)Solutions prepared with distilled water.

It should be noted that consistently superior results are obtained with the solutions of this invention in large scale operations e.g. by spray etching techniques. Specifically, the increase in etch rate as compared to that of a control solution is much more pronounced and also the actual etch times are substantially lower typically in the order of $\frac{5}{8}$ to $\frac{1}{3}$ of the values obtained using the small scale immersion technique described above.

EXAMPLES 6–15

In these examples, either 20 ml or 20 grams per liter of various diols not meeting the requirements of the invention were added to etch solutions of the same composition as that of Example 1. As seen from the data shown in Table II, the results of the etching tests were inferior in that etch rates especially in the presence of 45 ppm of added free chloride were unacceptable.

TABLE II

| Example No. | Additive Name | ml/l or (g/l) | Etch Time, Sec. Without Cl | With Cl (45 ppm) |
|---|---|---|---|---|
| 6 | Ethylene glycol | 20 | 135 | >350 |
| 7 | Diethylene glycol | 20 | 130 | >350 |
| 8 | Triethylene glycol | 20 | 130 | >350 |
| 9(1) | 1,2-Propanediol | 20 | 120 | >350 |
| 10(1) | 1,3-Propanediol | 20 | 90 | 250 |
| 11 | glycerol | 20 | 175 | — |
| 12 | 1,2-Dipropylene glycol | 20 | 95 | >350 |
| 13(1) | 2-methyl-2,4-pentane-diol | 20 | 100 | >350 |
| 14 | 2,5-Dimethyl-2,5-hexanediol | (20) | 90 | >200 |
| 15(1) | 1,2,6-Trihydroxy-hexane | 20 | 85 | 215 |

(1)Solutions prepared with distilled water.

EXAMPLES 16–21

In order to demonstrate the stabilizing effect had with the promoters of this invention a control solution (Example 16) prepared in distilled water and having the composition of Example 1 and also containing 38.2 g/liter (about 5 oz/gallon) of copper ions added in the form of 150 g/l cupric sulfate pentahydrate. The solution was maintained at 129° F. with constant agitation for 24 hours and the peroxide concentration was measured initially and then periodically during the test period by titration using a standard ceric ammonium sulfate solution with a ferroin indicator.

Example 17 was carried out in exactly the same fashion except that sodium phenol sulfonate, an excellent hydrogen peroxide stabilizer, was also added in conventional stabilizing quantities. To the solutions of Examples 18 to 21 the various diols shown in Table I were added in quantities generally known to promote optimum etch rates. The results of the tests indicate that the primary diols are extremely effective as stabilizers against hydrogen peroxide decomposition.

TABLE III

| Example No. | Stabilizer | Quantity Added ml/l (g/l) | vol % $H_2O_2$ (50% w/w) 0 Hrs. | 2 Hrs. | 18 Hrs. | 24 Hrs. |
|---|---|---|---|---|---|---|
| 16 | None | — | 14.8 | 10.4 | 0.4 | 0.2 |
| 17 | Sodiumphenolsulfonate | (2.5) | 14.8 | 14.8 | 11.6 | 10.7 |
| 18 | 1,4-Butanediol | 20 | 14.9 | 14.7 | 14.5 | 11.2 |
| 19 | 1,5-Pentanediol | 20 | 15.0 | 14.7 | 14.4 | 9.8 |
| 20 | 1,6-Hexanediol | (20) | 14.9 | 14.8 | 14.6 | 11.2 |
| 21 | 1,4-Cyclohexane-dimethanol | (20) | 14.9 | 14.7 | 14.4 | 8.1 |

EXAMPLES 22–26

To demonstrate the effect of concentration of the promoter on etch rates, the following comparative experiments were carried out at about 122° F. in a DEA-30 spray etcher using 2 × 2 inches samples of copper laminates having a coating of one ounce copper per square foot. The control solution (Example 22) contained 10 volume percent of 50% w/w hydrogen peroxide (1.8 gram moles/liter), 20 volume percent of 66° Baume sulfuric acid (3.6 gram moles/liter), 70 volume percent distilled water, to which also 1 gram per liter of sodium phenolsulfonate stabilizer and 15 grams per liter of copper sulfate pentahydrate were added.

In Examples 22–26 there was also included varying amounts of 1,4-butanediol. The effect of the diol concentrations on the etch times are shown in Table IV.

TABLE IV

| Example No. | 1,4-Butanediol ml/l | Etch Time, sec. |
|---|---|---|
| 22 | — | 635 |
| 23 | 5 | 69 |
| 24 | 10 | 58 |
| 25 | 15 | 54 |
| 26 | 20 | 54 |

It is obvious to those skilled in the art that many variations and modifications can be made to the specific embodiments discussed above. All such departures from the foregoing specification are considered within the scope of this invention as defined by this specification and the appended claims.

What is claimed is:

1. In a process for the dissolution of metal in which a metal is contacted with an aqueous solution containing free chloride or bromide ions, from about 0.2 to about 4.5 gram moles per liter of sulfuric acid and from about 0.25 to about 8 gram moles per liter of hydrogen peroxide, the method of increasing the metal dissolution rate of the solution in the presence of chloride or bromide ions to a value higher than that obtained by such a solution free of any chloride and bromide ions, which method comprises adding an effective amount of a primary diol promoter having the general formula:

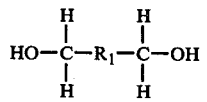

wherein $R_1$ is selected from:

(a) $-(C\ R_2\ R_3)_n-$, where each $R_2$ and $R_3$ independently from each other is either hydrogen or an alkyl group of 1 to 4 carbon atoms, and n is at least 2, or (b) a cycloparaffinic group or an alkyl-substituted cycloparaffinic group having from 5 to 7 carbon atoms in the ring structure and from 1 to 4 carbon atoms in any of the alkyl substitutions.

2. The method of claim 1, wherein said promoter is provided at a concentration of at least 0.01 gram moles per liter.

3. The method of claim 1, wherein said promoter is provided at a concentration in the range from about 0.1 to about 0.5 gram moles per liter.

4. The method of claim 1, wherein the aqueous solution contains sodium phenolsulfonate as a stabilizer to reduce the degrading effect of heavy metal ions on hydrogen peroxide.

5. The method of claim 1, wherein the hydrogen peroxide concentration is maintained between about 1 and about 4 gram moles per liter.

6. The method of claim 1, wherein the sulfuric acid concentration is maintained between about 0.3 and about 4 gram moles per liter.

7. The method of claim 1, wherein the promoter is 1,4-butanediol.

8. The method of claim 1, wherein the promoter is 1,5-pentanediol.

9. The method of claim 1, wherein the promoter is 1,6-hexanediol.

10. The method of claim 1, wherein the prometer is 1,4-cyclohexanedimethanol.

11. The method of claim 1, wherein the metal is copper or an alloy of copper.

12. The method of claim 1 carried out in the presence of at least 2 ppm of free chloride or bromide.

13. The method of claim 1, wherein the concentration of the promoter is at least 0.2 gram moles per liter and the dissolution is carried out in the presence of at least 25 ppm of free chloride or bromide.

14. In a composition for metal dissolution comprising an aqueous solution of free chloride or bromide ions, from about 0.2 to about 4.5 gram moles per liter of sulfuric acid and from about 0.25 to about 8 gram moles per liter of hydrogen peroxide, the presence of an effective amount of a primary diol promoter for increasing the metal dissolution rate of the solution in the presence of chloride or bromide ions to a value higher than that obtained by such a solution free of any chloride or bromide ions, said primary diol promoter having the general formula:

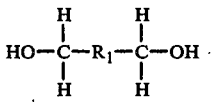

wherein $R_1$ is selected from:

(a) $-(C\ R_2\ R_3)_n-$, where each $R_2$ and $R_3$ independently from each other is either hydrogen or an alkyl group of 1 to 4 carbon atoms, and n is at least 2, or (b) a cycloparaffinic group or an alkyl-substituted cycloparaffinic group having from 5 to 7 carbon atoms in the ring structure and from 1 to 4 carbon atoms in any of the alkyl substitutions.

15. The composition of claim 14, wherein the promoter is provided at a concentration of at least about 0.01 gram moles per liter.

16. The composition of claim 14, wherein the promoter is provided at a concentration in the range from about 0.1 to about 0.5 gram moles per liter.

17. The composition of claim 14, additionally containing sodium phenolsulfonate as a stabilizer for reducing the degrading effect of heavy metal ions on hydrogen peroxide.

18. The composition of claim 14, wherein the hydrogen peroxide concentration is maintained between about 1 and about 4 gram moles per liter.

19. The composition of claim 14, wherein the sulfuric acid concentration is maintained about 0.3 and about 4 gram moles per liter.

20. The composition of claim 14, wherein the promoter is 1,4-butanediol.

21. The composition of claim 14, wherein the promoter is 1,5-pentanediol.

22. The composition of claim 14, wherein the promoter is 1,6-hexanediol.

23. The composition of claim 14, wherein the promoter is 1,4-cyclohexanedimethanol.

24. The composition of claim 14 containing free chloride or bromide ions in excess of 2 ppm.

25. The composition of claim 14 containing at least 0.2 gram moles per liter of the diol promoter and free chloride or bromide ions in excess of 25 ppm.

* * * * *

UNITED STATES PATENT AND TRADEMARK OFFICE

CERTIFICATE OF CORRECTION

PATENT NO. : 4,141,850

DATED : February 27, 1979

INVENTOR(S) : Philip D. Readio and John L. H. Allan

It is certified that error appears in the above-identified patent and that said Letters Patent are hereby corrected as shown below:

Column 5, line 26 "5/8 to 1/3" should read --- 1/3 to 2/3 ---.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*